US010622708B2

(12) United States Patent
Lee et al.

(10) Patent No.: US 10,622,708 B2
(45) Date of Patent: Apr. 14, 2020

(54) ANTENNA APPARATUS FOR VEHICLE

(71) Applicants: HYUNDAI MOTOR COMPANY, Seoul (KR); KIA MOTORS CORPORATION, Seoul (KR)

(72) Inventors: Sang Heun Lee, Seoul (KR); Ki-Nam Jin, Uijeongbu-si (KR); Yoon-Gi Kim, Gunpo-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 239 days.

(21) Appl. No.: 15/830,691

(22) Filed: Dec. 4, 2017

(65) Prior Publication Data

US 2019/0089041 A1 Mar. 21, 2019

(30) Foreign Application Priority Data

Sep. 19, 2017 (KR) ..... 10-2017-0120403

(51) Int. Cl.

| | |
|---|---|
| ***H01Q 1/32*** | (2006.01) |
| ***H01Q 1/42*** | (2006.01) |
| ***H01Q 1/48*** | (2006.01) |
| ***H01Q 1/12*** | (2006.01) |

(52) U.S. Cl.

CPC ..... *H01Q 1/3275* (2013.01); *H01Q 1/1214* (2013.01); *H01Q 1/42* (2013.01); *H01Q 1/48* (2013.01)

(58) Field of Classification Search

CPC ..... H01Q 1/32; H01Q 1/325; H01Q 1/3275; H01Q 1/3291; H01Q 1/42

See application file for complete search history.

(56) References Cited

U.S. PATENT DOCUMENTS

| | | | | |
|---|---|---|---|---|
| 7,091,913 | B2 * | 8/2006 | Lipka | H01Q 1/1207 343/713 |
| 9,455,494 | B2 * | 9/2016 | Lee | H01Q 1/1214 |
| 9,954,274 | B2 * | 4/2018 | Nakada | H01Q 1/3275 |
| 9,966,659 | B2 * | 5/2018 | Chakam | H01Q 1/1214 |

FOREIGN PATENT DOCUMENTS

| | | |
|---|---|---|
| KR | 10-1343814 B1 | 12/2013 |
| KR | 10-2015-0122475 A | 11/2015 |

* cited by examiner

*Primary Examiner* — Daniel Munoz
*Assistant Examiner* — Patrick R Holecek
(74) *Attorney, Agent, or Firm* — Morgan, Lewis & Bockius LLP

(57) ABSTRACT

An antenna apparatus for a vehicle includes a roof antenna disposed on a first side of a roof panel of a vehicle, a wireless communication module disposed on a second side of the roof panel of the vehicle, a first connection terminal provided in the roof antenna, a second connection terminal provided in the wireless communication module, the second connection terminal being flexibly coupled to the first connection terminal, and an elastic member having one end supported by the first connection terminal and another end supported by the second connection terminal.

12 Claims, 11 Drawing Sheets

ANTENNA APPARATUS FOR VEHICLE

CROSS-REFERENCE TO RELATED APPLICATION

This application claims the benefit of priority to Korean Patent Application No. 10-2017-0120403, filed on Sep. 19, 2017 with the Korean Intellectual Property Office, the entire disclosure of which is incorporated herein by reference.

TECHNICAL FIELD

Exemplary embodiments of the present disclosure relate to an antenna apparatus for a vehicle, the antenna apparatus including a roof antenna installed on a roof panel of the vehicle and a wireless communication module coupled to the roof antenna.

BACKGROUND

In recent years, an antenna apparatus for a vehicle, which is capable of integrally receiving a global positioning system (GPS) signals and digital multimedia broadcasting (DMB) signals, has been installed on roof panels of a vehicle.

The antenna apparatus for a vehicle includes a roof antenna provided on an upper surface of the roof panel, and a wireless communication module installed under the roof panel.

The roof antenna is connected to the wireless communication module by passing through the roof panel so that a signal received from the roof antenna can be transmitted to the wireless communication module.

However, since the roof panel is disposed between the roof antenna and the wireless communication module, a connection part between the roof antenna and the wireless communication module can be weakened due to vibrations generated by operations of the vehicle.

BRIEF SUMMARY

Therefore, it is an aspect of the present disclosure to provide an antenna apparatus for a vehicle, in which a connection between a roof antenna and a wireless communication module may be stably held even with vibration of the vehicle.

Additional aspects of the disclosure will be set forth in part in the description which follows and, in part, will be obvious from the description, or may be learned by practice of the disclosure.

In accordance with one aspect of the present disclosure, an antenna apparatus for a vehicle includes a roof antenna disposed over a roof panel of a vehicle, a wireless communication module disposed under the roof panel of the vehicle, a first connection terminal provided in the roof antenna, a second connection terminal provided in the wireless communication module and flexibly coupled to the first connection terminal, and an elastic member having one end supported by the first connection terminal and the other end supported by the second connection terminal.

The first connection terminal may have a hollow cylindrical shape extending downward, the second connection terminal may have a hollow cylindrical shape extending upward, and the elastic member may be formed as a coil spring having an upper end supported by the first connection terminal and a lower end supported by the second connection terminal.

The first connection terminal may include a first support sill provided to have a stepped shape at an outer peripheral surface of the first connection terminal to support an upper end of the elastic member, and the second connection terminal may include a second support sill protruding radially outward from an upper end of the second connection terminal to support a lower end of the elastic member.

The first connection terminal may include a plurality of hooks provided at a lower end of the first connection terminal in a circumferential direction.

The roof antenna may include a screw shaft configured to pass through the roof panel of the vehicle and the wireless communication module, and a fastening nut fastened to the screw shaft.

The wireless communication module may include a holding member configured to hold the screw shaft.

The screw shaft may include a thread part provided on a lower outer peripheral surface of the screw shaft, and a pair of chamfer parts provided on both upper sides of the thread part, and the holding member may include a frame part having a rectangular ring shape, and a holding part protruding inward from the frame part and supported by the chamfer part.

The roof antenna may include a latching member configured to assemble the roof antenna to the roof panel of the vehicle, and the latching member may include a pair of latching parts latched to a portion adjacent to a roof through-hole formed in the roof panel of the vehicle.

The wireless communication module may include a grounding member disposed over the wireless communication module and grounded to the roof panel.

The grounding member may be formed of an elastically deformable material, and the grounding member may include a mounting part mounted on the wireless communication module, and a pair of grounding parts inclined upward from both sides of the mounting part.

An upper end of each of the pair of grounding parts may have a sawtooth shape.

In accordance with another aspect of the present disclosure, an antenna apparatus for a vehicle includes a roof antenna disposed over a roof panel of the vehicle, and a wireless communication module disposed under the roof panel of the vehicle, wherein the roof antenna includes a screw shaft configured to pass through the roof panel of the vehicle and the wireless communication module, the wireless communication module includes a holding member configured to hold the screw shaft, the screw shaft includes a thread part provided on a lower outer peripheral surface of the screw shaft, and a pair of chamfer parts provided on both upper sides of the thread part, and the holding member includes a frame part having a rectangular ring shape, and a holding part protruding inward from the frame part and supported by the chamfer part.

In accordance with another aspect of the present disclosure, an antenna apparatus for a vehicle includes a roof antenna disposed over a roof panel of the vehicle, a wireless communication module disposed under the roof panel of the vehicle, and a latching member configured to assemble the roof antenna to the roof panel of the vehicle, wherein the latching member includes a pair of latching parts latched to a portion adjacent to a roof through-hole formed in the roof panel of the vehicle.

In accordance with another aspect of the present disclosure, an antenna apparatus for a vehicle includes a roof antenna disposed over a roof panel of the vehicle, and a wireless communication module disposed under the roof panel of the vehicle, wherein the wireless communication module includes a grounding member formed of an elastically deformable material and disposed over the wireless communication module, and the grounding member includes a mounting part mounted on the wireless communication module, and a pair of grounding parts inclined upward from both sides of the mounting part.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
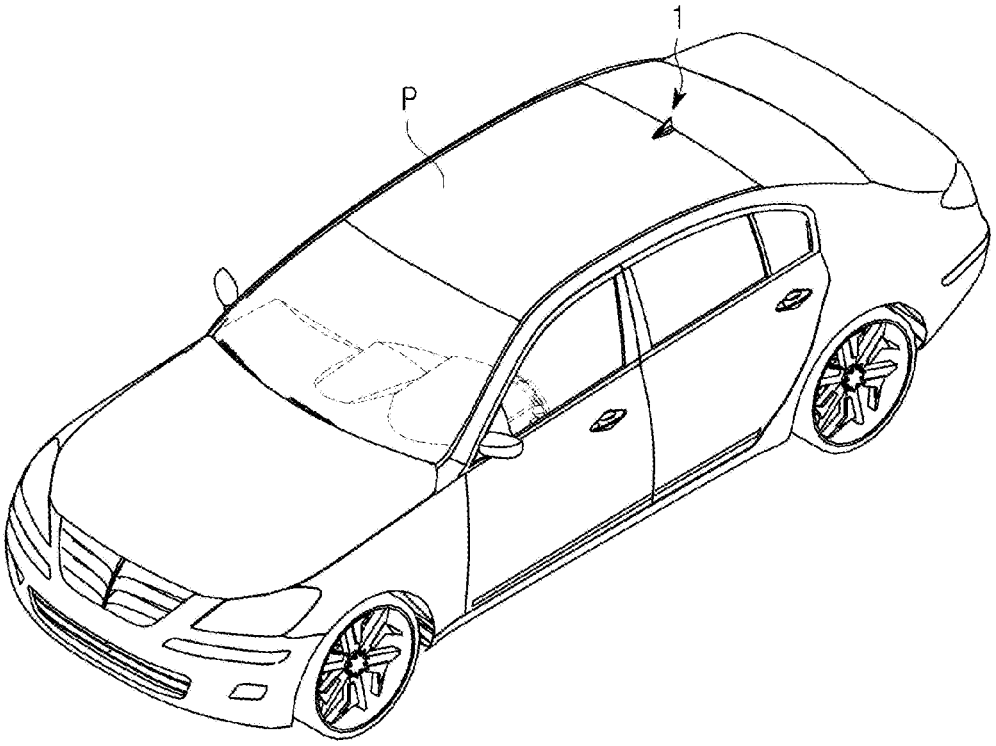
FIG. 1 is a perspective view illustrating a state in which an antenna apparatus for a vehicle in accordance with exemplary embodiments of the present disclosure is installed on a roof panel of the vehicle.

Embodiments described herein and configurations illustrated in the accompanying drawings are only exemplary examples of the present disclosure, and various modifications may be made at the time of filing of the present application to replace the embodiments and drawings of the present specification.

In addition, throughout the accompanying drawings of the present specification, the same reference numerals or symbols are used to designate parts or elements performing substantially the same function.

Terms used herein are intended to describe certain embodiments only, and shall by no means restrict and/or limit the present disclosure. Unless clearly used otherwise, expressions in a singular form include a meaning of a plural form. In the present specification, terms such as "comprising" or "including" are intended to designate the presence of characteristics, numbers, steps, operations, elements, parts or combinations thereof, and shall not be construed to preclude any possibility of presence or addition of one or more other characteristics, numbers, steps, operations, elements, parts or combinations thereof.

In addition, although any of the terms including ordinal numbers such as "first" or "second" may be used herein to describe various elements, the elements should not be limited by the terms. The terms are only used to distinguish one element from another. For example, a first element could be termed as a second element, and, similarly, a second element could be termed as a first element, without departing from the scope of the present disclosure. The term "and/or" includes any combination of a plurality of disclosed items related thereto, or one of a plurality of disclosed items related thereto.

Meanwhile, the terms such as "front," "rear," "upper," or "lower" used in the following description are defined based on the accompanying drawings, and the shape and position of each element are not limited by these terms.

In the following description, a vehicle refers to various devices for moving a transport target such as a human, an object, or an animal from an origin to a destination. Vehicles may include a vehicle running on roads or tracks, a ship sailing over the sea or river, an airplane flying in the air using the action of air, and the like.

In addition, the vehicle running on roads or tracks may move in a predetermined direction in accordance with rotation of at least one wheel, and may include, for example, three-wheeled or four-wheeled vehicles, construction machines, two-wheeled vehicles, prime mover devices, bicycles and trains running on a track.

Hereinafter, an antenna apparatus for a vehicle in accordance with exemplary embodiments of the present disclosure will be described in detail with reference to the accompanying drawings.

Figure 2:
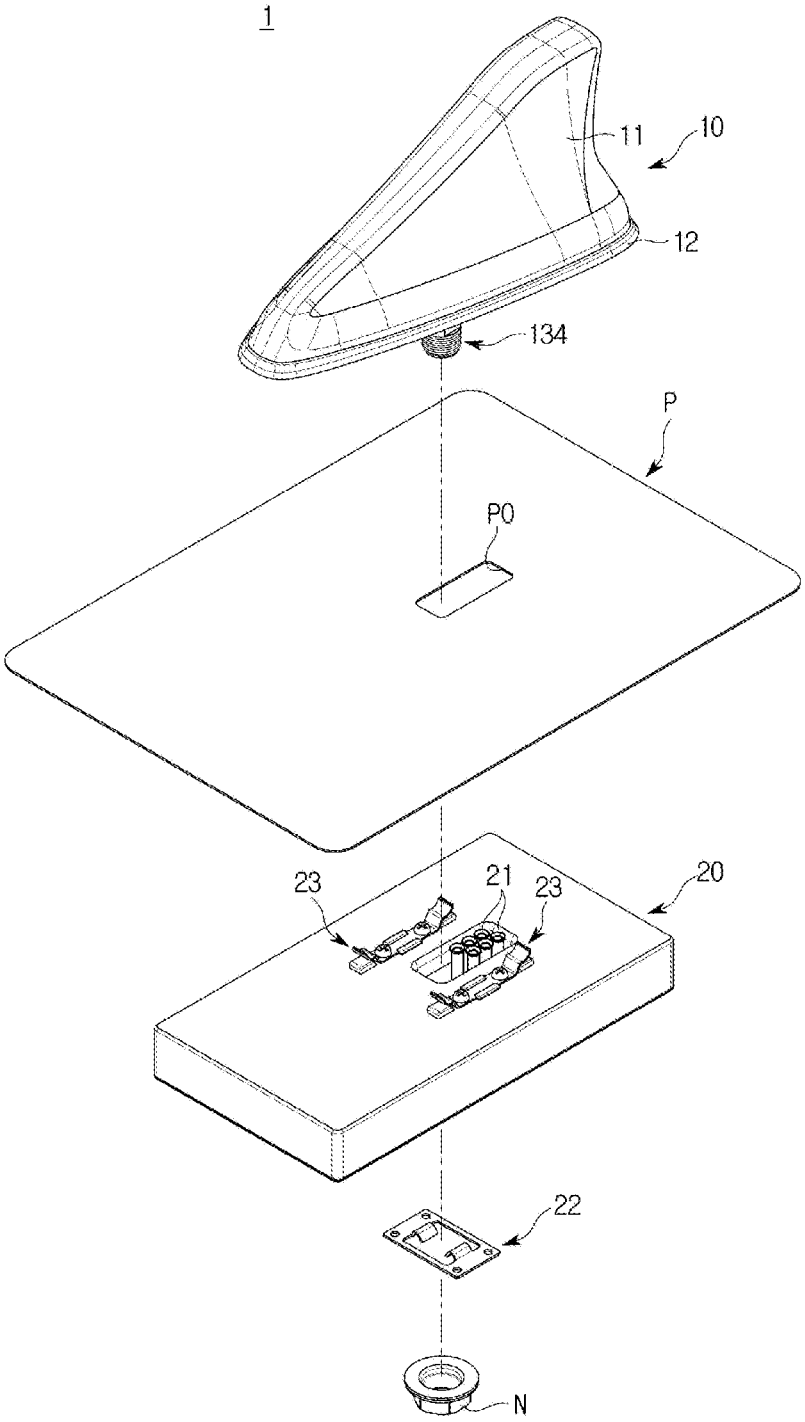
FIG. 2 is an upper exploded perspective view of an antenna apparatus for a vehicle in accordance with exemplary embodiments of the present disclosure.
Figure 3:
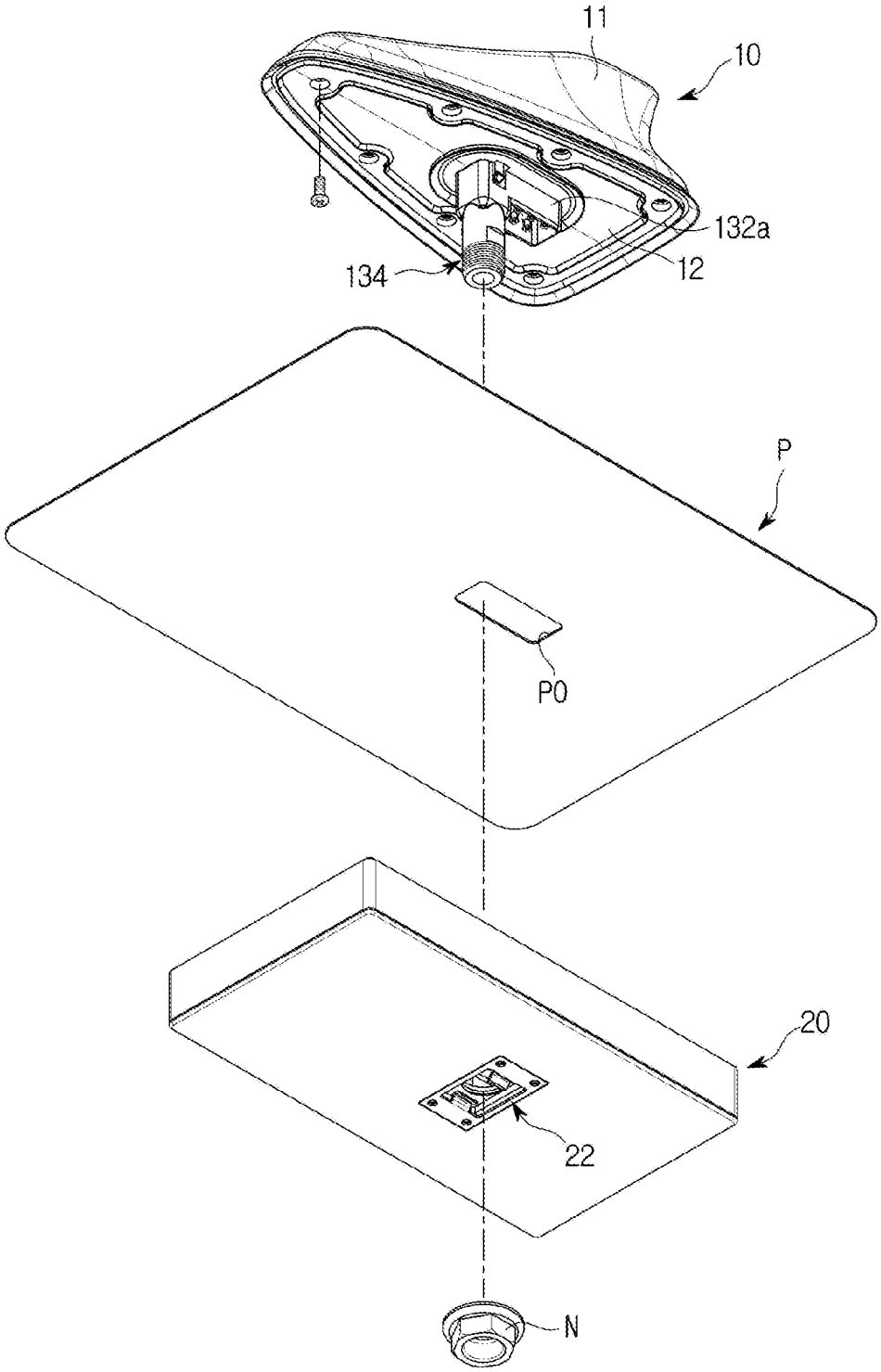
FIG. 3 is a lower exploded bottom perspective view of an antenna apparatus for a vehicle in accordance with exemplary embodiments of the present disclosure.

FIG. 1 is a perspective view of a vehicle in a state where a roof antenna in accordance with embodiments of the present disclosure is installed, and FIGS. 2 and 3 are exploded perspective views of an antenna apparatus for a vehicle in accordance with embodiments of the present disclosure.

Referring to FIGS. 1 to 3, an antenna apparatus 1 for a vehicle includes a roof antenna 10 mounted on an upper surface of a roof panel P of the vehicle, and a wireless communication module 20 mounted under the roof panel P of the vehicle.

The roof antenna 10 includes an antenna housing 11 forming an upper portion of the roof antenna 10, a base 12 configured to cover a lower surface of the antenna housing 11 and an antenna module 13 mounted on the base 12 and covered by the antenna housing 11.

The antenna module 13 includes an antenna substrate 131 configured to receive a wireless signal and a support plate 132 configured to support the antenna substrate 131.

Figure 4:
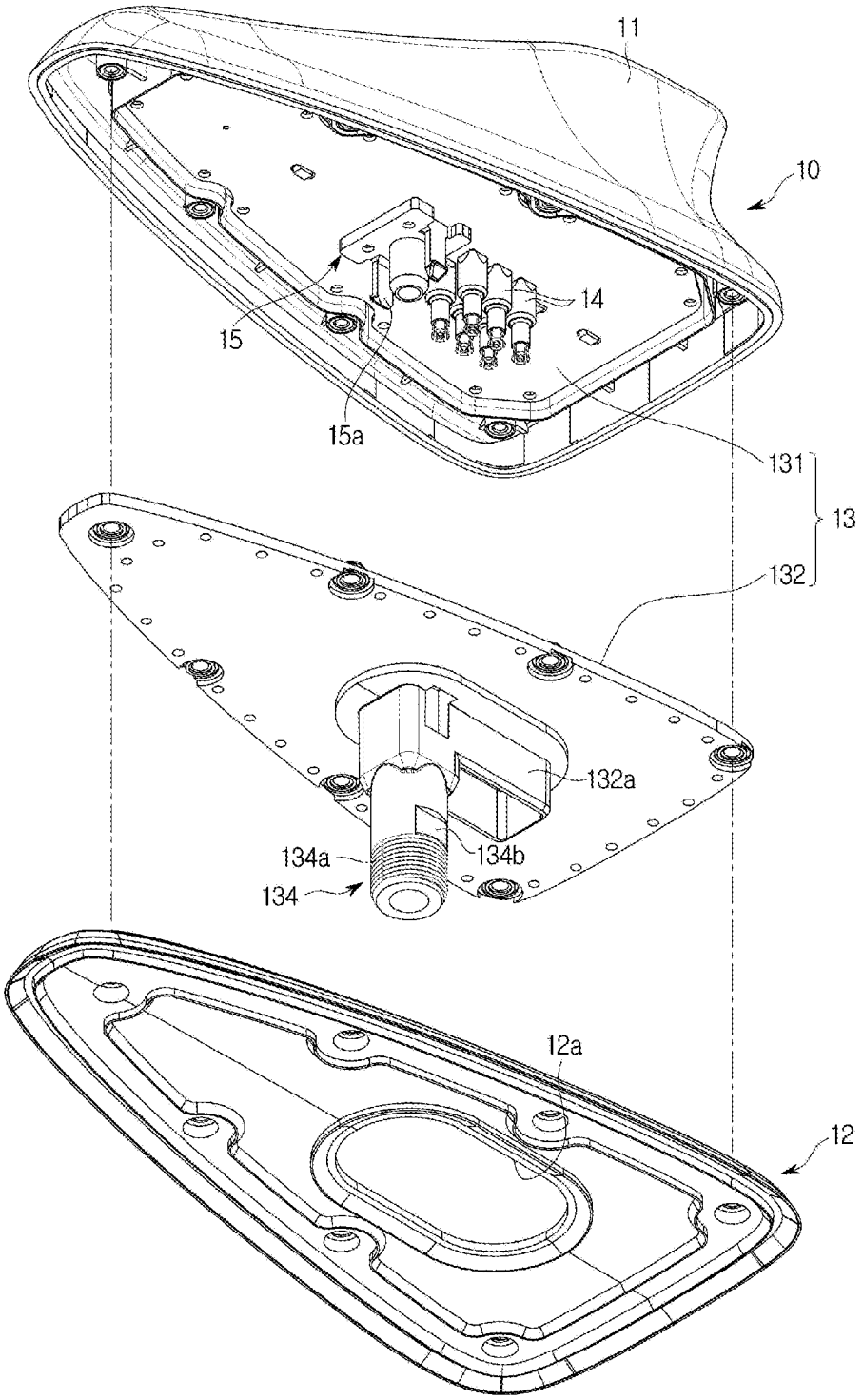
FIG. 4 is a lower exploded perspective view of a roof antenna applied to an antenna apparatus for a vehicle in accordance with exemplary embodiments of the present disclosure.

The antenna substrate 131 includes a plurality of first connection terminals 14 as shown in FIG. 4, and the wireless communication module 20 includes a plurality of second connection terminals 21 connected to the plurality of first connection terminals 14, as shown in FIG. 2. The first connection terminal 14 and the second connection terminal 21 are flexibly coupled to each other, and elastically supported against each other through an elastic member S.

The support plate 132 includes a terminal receptor 132*a* configured to receive the first connection terminals 14, and the base 12 includes a receptor through-hole 12*a* through which the terminal receptor 132*a* passes.

Figure 5:
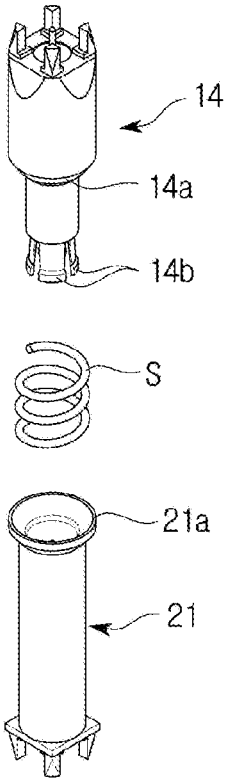
FIG. 5 is an exploded perspective view illustrating a state before a first connection terminal and a second connection terminal, applied to an antenna apparatus for a vehicle in accordance with exemplary embodiments of the present disclosure, are connected to each other.
Figure 6:
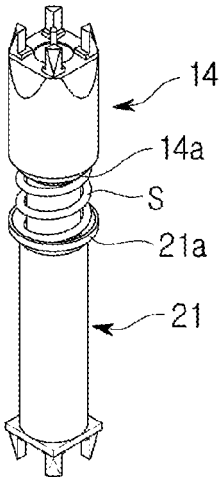
FIG. 6 is a perspective view illustrating a state in which a first connection terminal and a second connection terminal, applied to an antenna apparatus for a vehicle in accordance with exemplary embodiments of the present disclosure, are connected to each other.

As shown in FIGS. 5 and 6, the first connection terminal 14 is formed in a hollow cylindrical shape extending downward and is mounted on a lower surface of the antenna substrate 131. The first connection terminal 14 includes a first support sill 14*a* having a stepped shape at an outer peripheral surface of the first connection terminal 14 to support an upper end of the elastic member S, and a hook 14*b* provided at a lower end of the first connection terminal 14 and latched to a latching sill of the second connection terminal 21, which will be described below. A plurality of hooks 14*b* are arranged at the lower end of the first connection terminal 14 in a circumferential direction.

The second connection terminal 21 is formed in a hollow cylindrical shape extending upward, and is disposed in the wireless communication module 20. The second connection terminal 21 includes a second support sill 21*a* protruding radially outward from an upper end of the second connection terminal 21, and a latching sill (not shown) protruding radially inward from the upper end of the second connection terminal 21 to allow the above-mentioned hooks 14*b* to be latched.

The elastic member S is formed as a coil spring, the upper end of the elastic member S is supported by the first support sill 14*a* and a lower end of the elastic member S is supported by the second support sill 21*a*.

Figure 7:
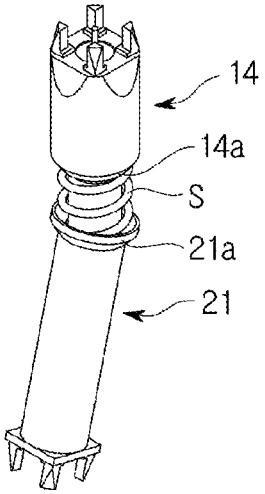
FIG. 7 is a perspective view illustrating a case where vibrations from vehicle operations are transmitted to a first connection terminal and a second connection terminal in a state where the first connection terminal and the second connection terminal, applied to the antenna apparatus for a vehicle in accordance with exemplary embodiments of the present disclosure, are connected to each other.

Since the first connection terminal 14 and the second connection terminal 21 can be flexible with respect to each other through the hook 14*b* and the latching sill while being elastically supported against each other through the elastic member S, even when locations of the first connection terminal 14 and the second connection terminal 21 are partially deviated as shown in FIG. 7 due to the transmission of vibration of the vehicle, the connection between the first connection terminal 14 and the second connection terminal 21 is stably held by an elastic restoring force of the elastic member S.

The antenna apparatus 1 for a vehicle is installed on the roof panel P of the vehicle by coupling the roof antenna 10 with the wireless communication module 20 with the roof panel P of the vehicle interposed therebetween.

In order to couple the roof antenna 10 to the wireless communication module 20, the roof antenna 10 includes a screw shaft 134 extending downward, configured to pass through a roof through-hole P0 formed in the roof panel P of the vehicle and the wireless communication module 20, and protruding downward from the wireless communication module 20, in which a fastening nut N is fastened to a lower end of the screw shaft 134.

The screw shaft 134 includes a thread part 134*a* formed on a lower outer peripheral surface of the screw shaft 134. The thread part 134*a* is a portion where a male screw is formed, and the thread part 134*a* is fastened to the fastening nut N.

Figure 8:
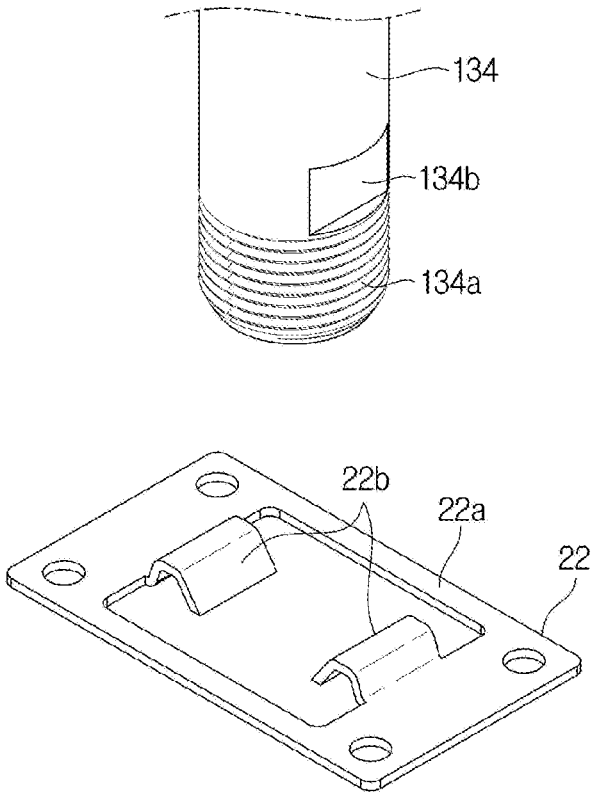
FIG. 8 is a perspective view of a screw shaft and a holding member applied to an antenna apparatus for a vehicle in accordance with exemplary embodiments of the present disclosure.

In order to assemble the roof antenna 10 to the wireless communication module 20, the screw shaft 134 includes a pair of chamfer parts 134*b* provided on both upper sides of the thread part 134*a*, and the wireless communication module 20 includes a holding member 22 as shown in FIGS. 2 and 8.

The holding member 22 includes a frame part 22*a* having a rectangular ring shape and coupled to a lower portion of the wireless communication module 20, and a holding part 22*b* protruding inward from the frame part 22*a* and supported by the chamfer part 134*b*.

Figure 11:
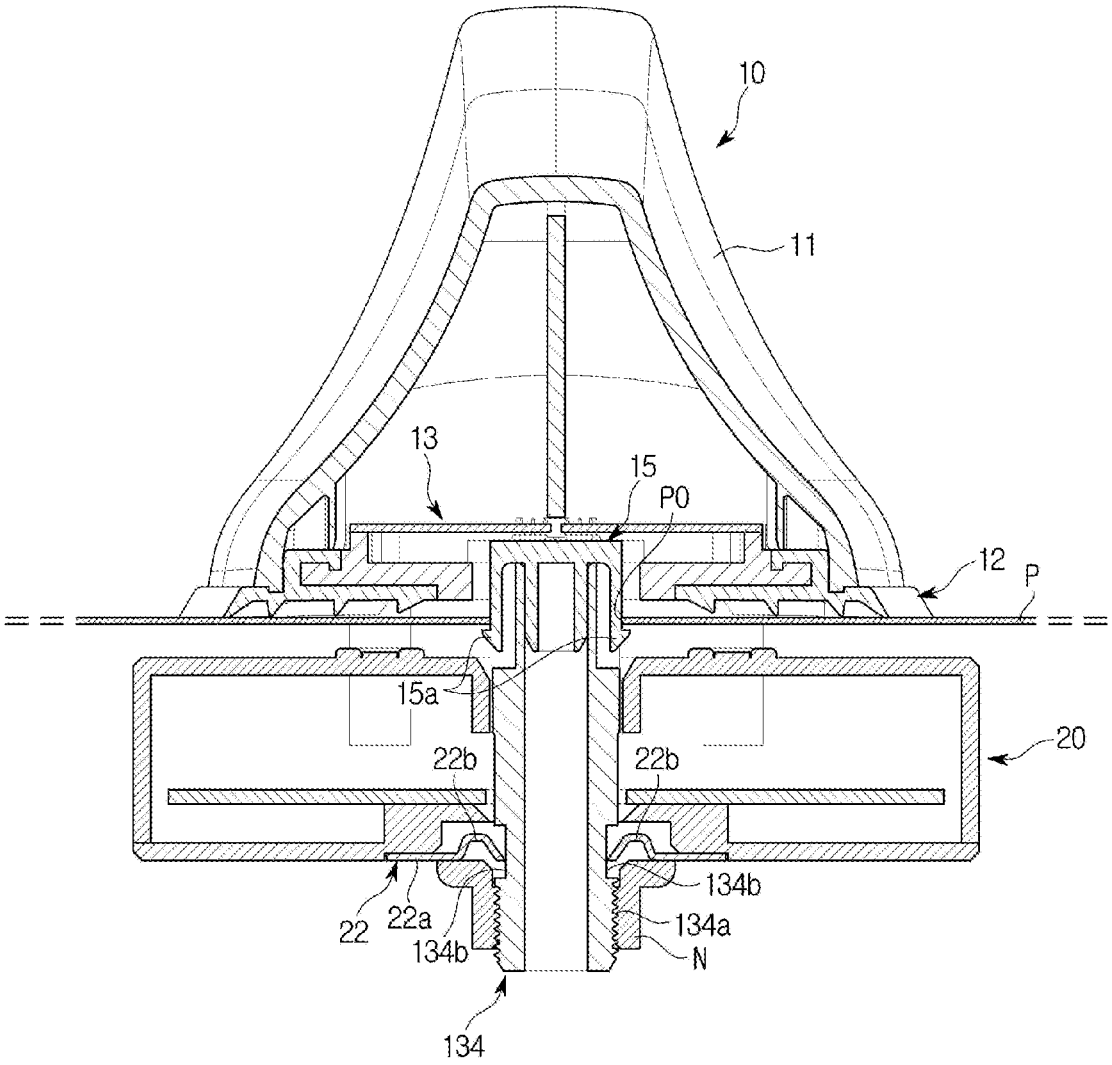
FIG. 11 is a cross sectional view illustrating an installation state of a latching member and a holding member applied to an antenna apparatus for a vehicle in accordance with exemplary embodiments of the present disclosure.

In addition, in order to assemble the roof antenna 10 to the roof panel P, the roof antenna 10 includes a latching member 15 as shown in FIGS. 4 and 11. The latching member 15 includes a pair of latching parts 15*a*, and the latching parts 15*a* are configured to pass through the roof through-hole P0 formed in the roof panel P and latched to a portion adjacent to the roof through-hole P0.

The antenna apparatus for a vehicle is grounded to the roof panel P of the vehicle. To this end, as shown in FIG. 2, the wireless communication module 20 includes a grounding member 23 disposed on an upper portion of the wireless communication module 20. The grounding member 23 is formed of a conductive material, and two grounding members 23 are arranged in parallel.

Figure 9:
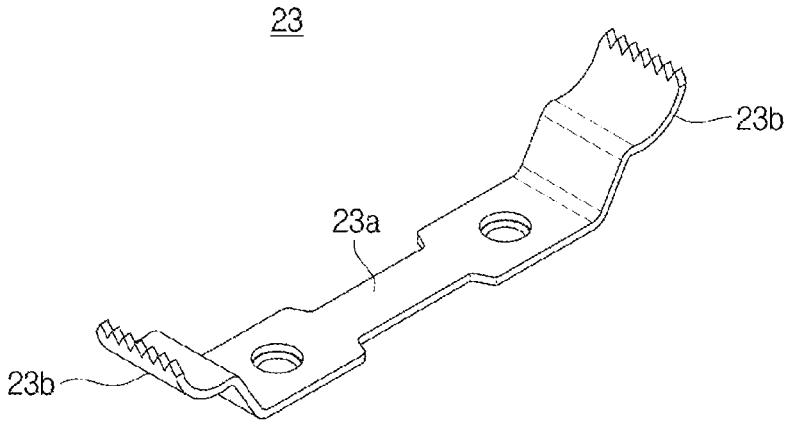
FIG. 9 is a perspective view of a grounding member applied to an antenna apparatus for a vehicle in accordance with exemplary embodiments of the present disclosure.
Figure 10:
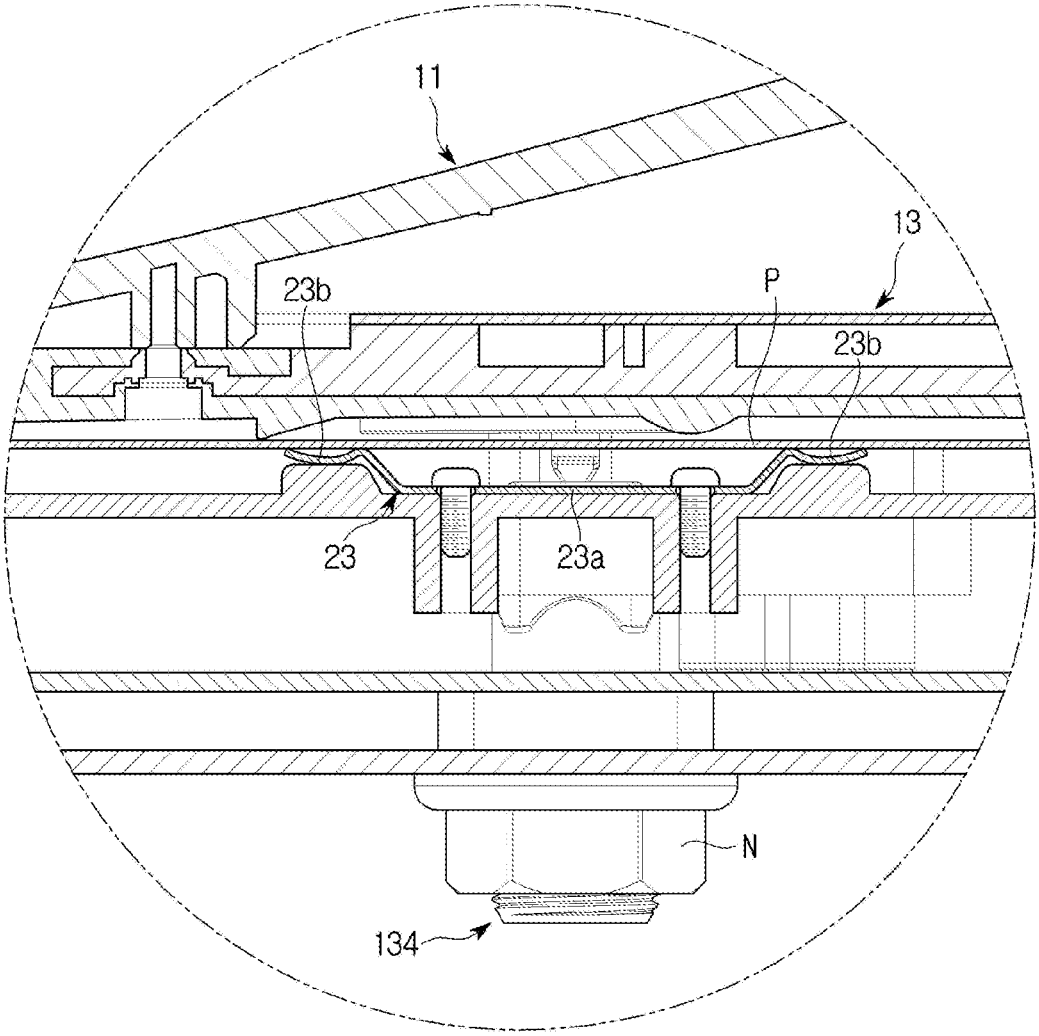
FIG. 10 is a cross sectional view illustrating an installation state of a grounding member applied to an antenna apparatus for a vehicle in accordance with exemplary embodiments of the present disclosure.

As shown in FIG. 9, the grounding member 23 is formed of an elastically deformable material, and includes a mounting part 23*a* mounted on the wireless communication module 20 and a pair of grounding parts 23*b* inclined upward from both sides of the mounting part 23*a*. Upper ends of the grounding parts 23*b* can have a sawtooth shape, so that the grounding parts 23*b* may peel off a coating on a lower surface of the roof panel P.

Hereinafter, the installation of the antenna apparatus for a vehicle of the present disclosure configured as described above will be described.

First, the roof antenna 10 is moved downward in a state where the roof antenna 10 and the wireless communication module 20 are disposed on upper and lower sides, or roof sides, on the basis of the roof through-hole P0, so that the screw shaft 134 may pass through the roof through-hole P0 and the wireless communication module 20.

In the process of moving the roof antenna 10 downward, the latching part 15*a* of the latching member 15 passes through the roof through-hole P0 and is latched to, and supported by, a portion adjacent to the roof through-hole P0. Therefore, the roof antenna 10 is assembled, or attached, to the roof panel P.

In addition, the screw shaft 134 passes between two holding parts 22*b* of the holding member 22, and the chamfer parts 134*b* of the screw shaft 134 are supported between the two holding parts 22*b*. Therefore, the roof antenna 10 and the wireless communication module 20 are also assembled, or mutually attached.

When the fastening nut N is fastened to the thread part 134*a* in a state where the roof antenna 10 and the wireless communication module 20 are assembled as described above, as the fastening nut N is fastened, the wireless communication module 20 moves toward the roof panel P by the fastening nut N.

As the wireless communication module 20 moves, an upper end of the grounding part 23*b* of the grounding member 23 mounted on the upper portion of the wireless communication module 20 comes into contact with the lower surface of the roof panel P.

When the wireless communication module 20 continues to move upward in a state where the grounding part 23*b* is in contact with the lower surface of the roof panel P, the upper end of the grounding part 23*b* moves along the lower surface of the roof panel P as the grounding part 23*b* is elastically deformed. Since the upper end of the grounding part 23*b* has a sawtooth shape, the coating on the lower surface of the roof panel P is peeled off, and accordingly, the upper end of the grounding part 23*b* is grounded to the roof panel P.

Since the grounding member 23 is formed of an elastically deformable material, the grounding member 23 also serves to elastically support the wireless communication module 20 against the roof panel P.

As is apparent from the above description, in an antenna apparatus for a vehicle in accordance with exemplary embodiments of the present disclosure, since a first connection terminal and a second connection terminal are provided to be flexible with respect to each other and are elastically supported against each other through an elastic member, the first connection terminal and the second connection terminal can hold a stable connection, and/or mounting, state thereof even when vibrations from vehicle operations are transmitted thereto.

The scope of the present disclosure is not limited to the specific embodiments described above. It will be understood by those skilled in the art that various changes and modifications can be made without departing from the spirit and scope of the present disclosure as defined by the appended claims.

What is claimed is:

1. An antenna apparatus for a vehicle, the antenna apparatus comprising:

a roof antenna disposed on a first side of a roof panel of the vehicle;

a wireless communication module disposed on a second side of the roof panel;

a first connection terminal disposed in the roof antenna;

a second connection terminal disposed in the wireless communication module, the second connection terminal being flexibly coupled to the first connection terminal; and an elastic member having one end supported by the first connection terminal and another end supported by the second connection terminal, wherein the roof antenna includes a screw shaft passing through the roof panel and the wireless communication module, wherein the wireless communication module includes a holding member for holding the screw shaft, wherein the screw shaft includes:

a thread part disposed on a lower outer peripheral surface of the screw shaft; and a pair of chamfer parts disposed on both upper sides of the thread part, and wherein the holding member includes:

a frame part having a rectangular ring shape; and a holding part protruding inward from the frame part and supported by the chamfer part.

2. The antenna apparatus of claim 1, wherein the first side and the second side are substantially opposed surfaces of the roof panel.

3. The antenna apparatus of claim 1, wherein the first side corresponds to an upper side of the roof panel and the second side corresponds to a lower side of the roof panel.

4. The antenna apparatus of claim 1, wherein the first connection terminal has a hollow cylindrical shape extending downward, wherein the second connection terminal has a hollow cylindrical shape extending upward, and wherein the elastic member is a coil spring having an upper end supported by the first connection terminal and a lower end supported by the second connection terminal.

5. The antenna apparatus of claim 4, wherein the first connection terminal includes a first support sill having a stepped shape at an outer peripheral surface of the first connection terminal to support an upper end of the elastic member, and wherein the second connection terminal includes a second support sill protruding radially outward from an upper end of the second connection terminal to support a lower end of the elastic member.

6. The antenna apparatus of claim 5, wherein the first connection terminal includes a plurality of hooks disposed at a lower end of the first connection terminal in a circumferential direction.

7. The antenna apparatus of claim 1, wherein the roof antenna includes a latching member for assembling the roof antenna to the roof panel of the vehicle, and wherein the latching member includes a pair of latching parts latched to a portion adjacent a roof through-hole defined in the roof panel of the vehicle.

8. The antenna apparatus of claim 1, wherein the wireless communication module includes a grounding member disposed over the wireless communication module and grounded to the roof panel.

9. The antenna apparatus of claim 8, wherein the grounding member is composed of an elastically deformable material, and the grounding member includes a mounting part mounted on the wireless communication module, and a pair of grounding parts inclined upward from both sides of the mounting part.

10. The antenna apparatus of claim 9, wherein an upper end of each of the pair of grounding parts has a sawtooth shape.

11. An antenna apparatus for a vehicle, the antenna apparatus comprising:

a roof antenna disposed over a roof panel of the vehicle; and a wireless communication module disposed under the roof panel of the vehicle, wherein the roof antenna includes a screw shaft passing through the roof panel of the vehicle and the wireless communication module, wherein the wireless communication module includes a holding member for holding the screw shaft, wherein the screw shaft includes:

a thread part disposed on a lower outer peripheral surface of the screw shaft; and a pair of chamfer parts disposed on both upper sides of the thread part, and wherein the holding member includes:

a frame part having a rectangular ring shape; and a holding part protruding inward from the frame part and supported by the chamfer part.

12. An antenna apparatus for a vehicle, the antenna apparatus comprising:

a roof antenna disposed over a roof panel of the vehicle; and a wireless communication module disposed under the roof panel, wherein the wireless communication module includes a grounding member composed of an elastically deformable material and disposed over the wireless communication module, and the grounding member includes:

a mounting part mounted on the wireless communication module; and a pair of grounding parts inclined upward from both sides of the mounting part wherein an upper end of each of the pair of grounding parts has a sawtooth shape.

* * * * *